US006032439A

United States Patent [19]

Birkenfeld et al.

[11] Patent Number: 6,032,439

[45] Date of Patent: Mar. 7, 2000

[54] APPARATUS AND METHOD OF COVERING A STACK OF ARTICLES

[75] Inventors: Richard Birkenfeld; Peter Aka, both of Beckum; Siegfried Kessel, Dortmund, all of Germany

[73] Assignee: Maschinenfabrik Möllers GmbH u. Co., Beckum, Germany

[21] Appl. No.: 09/123,745

[22] Filed: Jul. 27, 1998

[30] Foreign Application Priority Data

Jul. 26, 1997 [DE] Germany ..... 197 32 298

[51] Int. Cl.[7] ..... B65B 53/00

[52] U.S. Cl. ..... 53/441; 53/459; 53/556; 53/567

[58] Field of Search ..... 53/441, 556, 585, 53/567, 459, 574

[56] References Cited

U.S. PATENT DOCUMENTS 4,063,401 12/1977 Higgins ..... 53/567
4,473,990 10/1984 Thimon ..... 53/567
4,546,598 10/1985 Karpisek ..... 53/567 X
5,006,196 4/1991 Vandevoorde ..... 53/585 X

FOREIGN PATENT DOCUMENTS 2230549 12/1974 France ..... 53/567

*Primary Examiner*—Linda Johnson
*Attorney, Agent, or Firm*—Brown & Wood, LLP

[57] ABSTRACT

An apparatus for and a method of covering a stack formed of articles supported on a support pallet with a stretch film, with the apparatus including at least four reefing fingers movable in horizontal and vertical directions for picking up a film cover in four corners of the cover in a bellow-like manner, and four rigid stretching elements associated with respective reefing fingers, with the method including moving the reefing fingers horizontally into four corner regions of the cover and placing the cover around the reefing fingers in a bellows-like manner, moving, before an end of the placing process, the stretching elements radially outwardly and above the respective associated reefing fingers and moving the stretching elements, after reefing and before start of a pull-over process, inward in a direction toward the stack until the stretching elements are located closer to the stack than the respective reefing fingers, moving the reefing fingers away from the stack and thereafter, pulling the cover over the stack.

8 Claims, 3 Drawing Sheets

APPARATUS AND METHOD OF COVERING A STACK OF ARTICLES

BACKGROUND OF THE INVENTION

1. Field of the Invention

The present invention relates to an apparatus for covering a stack formed of articles supported on a support board with a stretch film and including at least four reef fingers movable in horizontal and vertical directions for picking up a film cover in four corners of the cover in a bellow-like manner, with each reefing finger having a somewhat L-shaped arch, and an adjustment drive unit associated with each reefing finger for folding, in the bellows-like manner, the film cover onto an associated reefing finger.

The present invention also relates to a method of covering a stack by using the above-described apparatus, with the method including moving the reefing fingers horizontally in four corner regions of the cover, so that the reefing fingers engage the cover in the four corner regions, placing the cover around the reefing fingers in a bellows-like manner, moving the reefing fingers away over a horizontal surface exceeding a horizontal dimension of the stack, and thereafter, pulling the cover over the stack, with the cover being initially supported on upper edges of the stack.

2. Description of the Prior Art

An apparatus and a method, which are described above, are disclosed, e.g., in German Patent No. 4,307,287. The method disclosed in the German patent has certain advantages over the previously known method and which consists in that for covering a stack having a variable cross-section along its height, the reefing fingers are displaced horizontally during their vertical movement, in order to accommodate the stack profile, in such a way that a stretched opening of the cover, which is formed by the reefing fingers, decreases or increases, with the reefing fingers being spaced from respective corner regions of the stack by the substantially the same distance. Thereby, it became possible, by controlling the horizontal movement of the reefing fingers, to adapt the position of the reefing fingers and, thus, the position of the film cover exactly to the profile of the stack during vertical displacement of the fingers and pulling of the cover over the stack. As a result, the released, by the reefing fingers, regions of the film cover are located at approximately the same distance from the stack circumference, whereby substantially uniform strips of the cover are released by reefing fingers. As a result of this, overstretching of film and damage of the cover, when a stack having a variable profile is covered, have been substantially reduced.

The method disclosed in German patent No. 4,307,287 insures a substantially good pulling of a horizontally stretched cover over the stack. However, under certain circumstances, an uncontrolled sliding of the cover from the fingers, in particular at the end of the pulling-over process, in the region of so-called bottom stretching, takes place. Therefore, measures need be undertaken to insure that the lower edge of the film cover lies beneath the pallet and does not ride up along the side walls of the stack.

German Publication DE 24 40 51 A1 discloses an apparatus for covering a stack of articles supported on a support board or pallet with a heat-shrinkable film and which includes finger-like elements for pulling a cover, which is formed of this film, over the stack. The finger-like elements are associated with spring-biased plate-shaped elements which should insure a uniform release of the reefed cover during its pulling. The disclosed apparatus does not provide for a controlled guiding of the corner regions of the cover.

Accordingly, an object of the present invention is to improve the sliding of reefed and horizontally stretched cover when the cover is pulled over the stack.

SUMMARY OF THE INVENTION

This and other objects of the present invention, which will become apparent hereinafter, are achieved with an apparatus of the described type in which there are provided, additionally, rigid stretching elements associated with respective reefing fingers and movable relative thereto in such a way that a respective region of the cover, upon being pulled over the stack moves over a respective reefing finger in a S-shaped manner and finally slides over a respective stretching element.

It has been proved that the apparatus according to the present invention permits to achieve a substantially better and controlled sliding of the film cover upon pulling the cover over the stack. The rigid stretching elements constructively are formed similar to the reefing fingers. By a corresponding arrangement of respective stretching elements during the covering process, a twin S-shaped sliding with a sliding friction of the respective cover region takes place. Namely, once from the arched reefing fingers and then, in a direction opposite to the covering direction, from the additional stretching elements. Thereby, providing additional stretching element permits to substantially increase a contact angle, necessary to obtain a required friction, in comparison with the case when only reefing fingers are used (from less than 90° to more than 360°, dependent on the shape of the stretching element). The increase of the friction contact surfaces prevents an uncontrolled slippage, but also insures a uniform sliding. This present a particular advantage during the stretching not only of the cover over the stack bottom because in this case, the lower end regions of the cover do not slide upward along the stack sides. It should be pointed out that providing of the stretching elements does not complicate in any substantial way the construction of the apparatus as they can be easily mounted on the reefing fingers frames and the like.

To this end, preferably, respective rigid stretching elements and respective reefing fingers are mounted on common frames. In this case, the stretching elements can be displaced, together with the reefing fingers, along the stack height. To provide for movement of the stretching elements relative to the reefing fingers, only additional horizontal and vertical adjustments of the stretching elements relative to the frame need be insured.

The necessary adjustments of the stretching elements relative to the frame can be effected in a simple manner by arranging the stretching element of a twin-arm linkage which is secured on the frame. Then, as a drive, a piston-cylinder unit or the like can be used.

In constructively simplest embodiment of the stretching element, its cross-section is round. Dependent on the desired contact angle and thereby achievable friction contact surface, the cross-section of the stretching element can be made oval, ovoid, or have any other suitable shape.

In a particularly preferred embodiment of the present invention, the length of the reefing finger and of the rigid stretching element is so selected that they form in the pull-over position at least a partially closed ring. The lengthening of the reefing finger and of the stretching element permits to further improve the controlled sliding of the film cover which is particularly advantageous for achieving a most possible uniform stretching along all of the side of the stack. To this end, the reefing finger and the stretching element can be telescopically formed in order to be able to be brought sufficiently close to each other for taking over the cover before pulling it over the stack.

The present invention also relates to a method of covering a stack which is characterized, according to the present invention by moving, before an end of the placing process, the stretching elements radially outward and above the respective associated reefing fingers and moving the stretching elements, after reefing and before start of a pull-over process inward in a direction toward the stack until the stretching elements are located closer to the stack than the respective reefing fingers.

This controlled movement of the stretching elements does not interfere with the operation of the apparatus during taking the cover over and its reefing. The stretching elements are brought into their functional position only then when the pulling over process actually starts. At the end of the pulling the cover over, the stretching elements are again displaced outwardly.

In order to be able to adjust the desired contact angle and thereby the friction contact surface in a particular case, it is contemplated to further displace the stretching elements, after they were displaced inward, additionally vertically downwardly. Thereby a substantial increase of the contact surfaces by increasing the contact angle becomes possible.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DESCRIPTION OF THE PREFERRED EMBODIMENT

Figure 1:
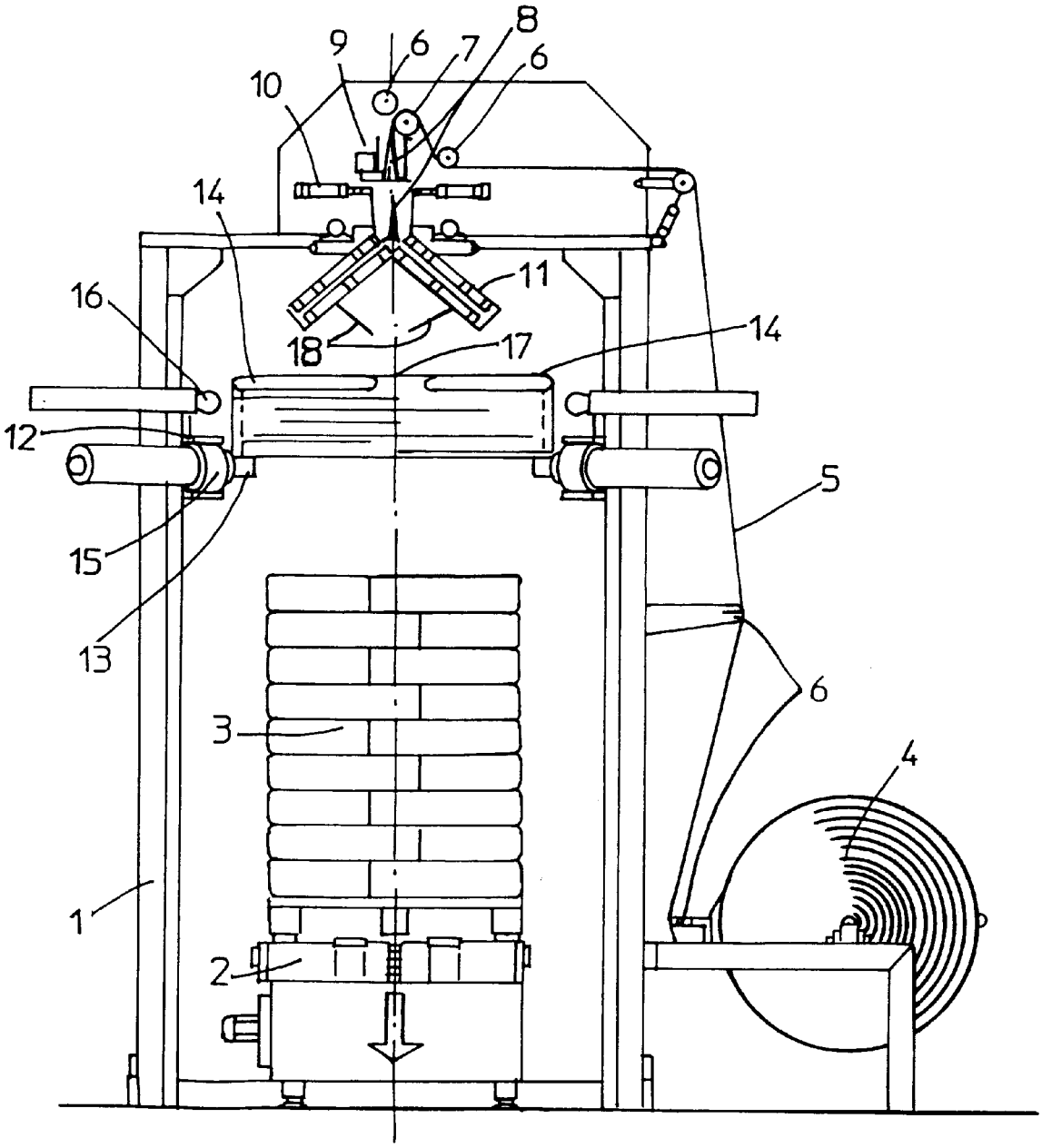
FIG. 1. shows a simplified side view of an apparatus for covering a stack according to the present invention.

FIG. 1 shows a general view an apparatus according to the present invention for covering a stack of a plurality of articles supported on a base plate with a stretch film. The apparatus has a stand 1 inside of which a stack 3 is supported on a track. In the stand 1, there is arranged a roll 4 with a wound-up plastic tubing 5 of a stretchable material and with folded sides. The stretchable material here is a material which, after being stretched, returns to its initial condition before stretching. The tubing 5, which is wound up on the roll 4 with its side edges being folded, is fed via deflection rollers 6 and drive rollers 7 to a threading device provided with vertical guide elements 8. The apparatus further includes a cutting or separating device 9 and a welding device 10.

Beneath the guide elements 8, there are provided, on opposite sides of the stand 1, two twin conveyor belts 11, which form together a roof-shaped structure. The upper, receiving ends of the conveyor belts, in their lowered position, are located immediately beneath the guide elements 8. Each twin conveyor belt 11 is associated with a pivot lever 18. In the plan view, lever 18 is located somewhat inward of the associated twin conveyor belt 11.

In the stand 1, a circulating continuous chain (not shown) is arranged adjacent to the four corners of the stand 1. Two slides 12 are secured to the chain for displacement parallel to the travel direction of the stack. Each slide 12 is provided with two vertical reefing finger supports 13 for supporting horizontally arranged bow-shaped reefing fingers 14 which arranged relative to each other somewhat at a right angle. Each of the reefing finger 14 is adjustable in both longitudinal and traverse direction to accommodate different dimension of the stack 3. To this end, there are provided respective frames 15 which are horizontally adjustable relative to the respective slide 12. At the upper end of each reefing finger 14, there is provided an outwardly located drive roller 16 which moves in a direction toward the reefing finger 14, in a manner not shown in detail, in an operating position shown, e.g., in FIG. 3. The drive roller 16 moves away from the reefing finger 14 in an non-operational position (not shown).

Figure 2:
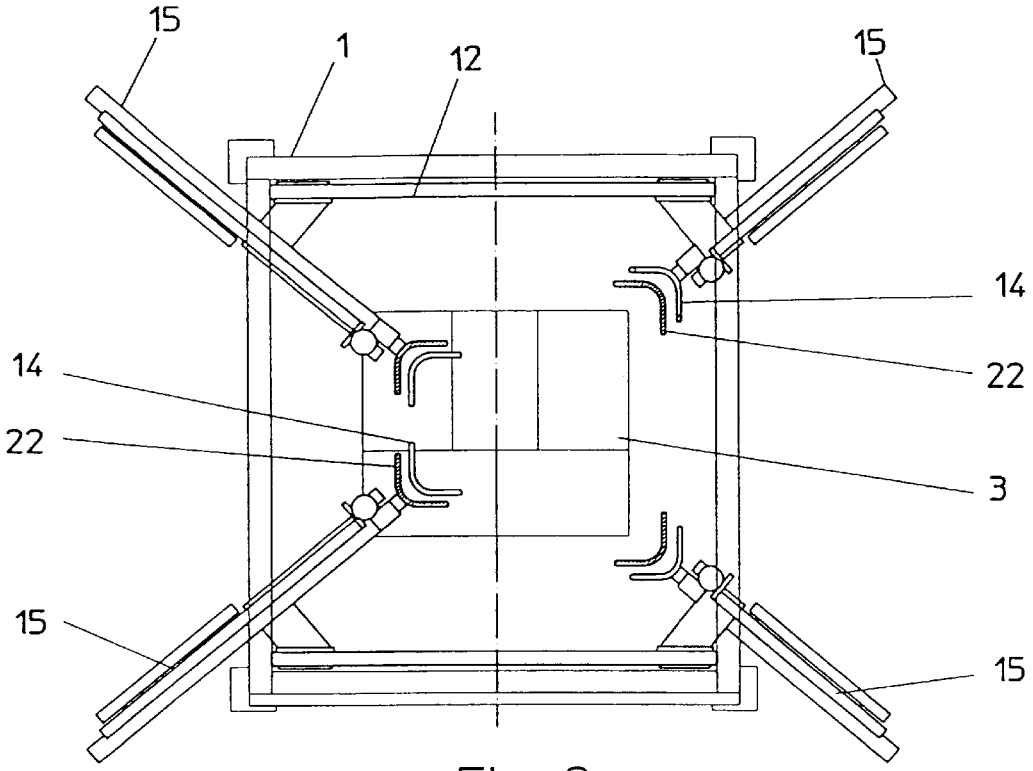
FIG. 2 shows a plan view of a top covering device of a covering apparatus according to the present invention with four reefing fingers and four additional stretching elements.
Figure 3:
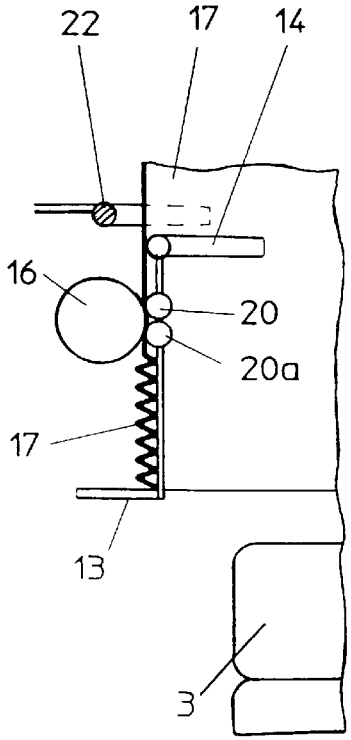
FIG. 3 shows a side view of a reefing finger and of an associate stretching element in a first position.

As best shown in FIG. 2, the covering apparatus according to the present invention is essentially characterized in that an additional rigid, preferably, an arched L-shaped stretching element 22 is associated with each reefing finger 14. The stretching element 22, as shown in FIG. 2, is arranged on the same frame 15 as the associated reefing finger 14. In the position shown in the left half of FIG. 2, in which the film cover is not yet pulled over the stack, the stretching element is located outwardly and above the respective associated reefing finger. This position of the stretching element is also shown in FIG. 3. The right half of FIG. 2 shows a covering process. In this position, the reefing finger 14 moves outwardly, and the stretching element 22 is located somewhat radially inwardly of the respective associated reefing finger 14. This position of the stretching element 22 with respect to its associated reefing finger 14 is also shown in FIGS. 4 and 5.

Figure 4:
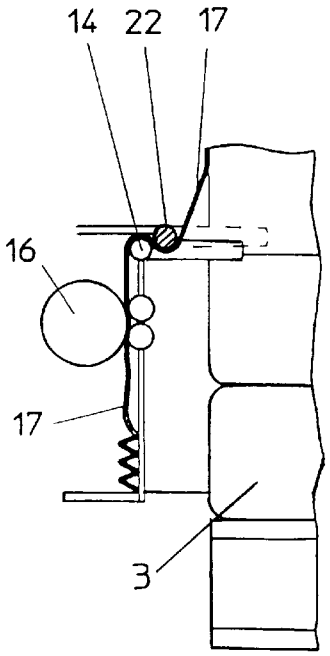
FIG. 4 shows a side view of the reefing finger and the associated stretching element in a second position.
Figure 5:
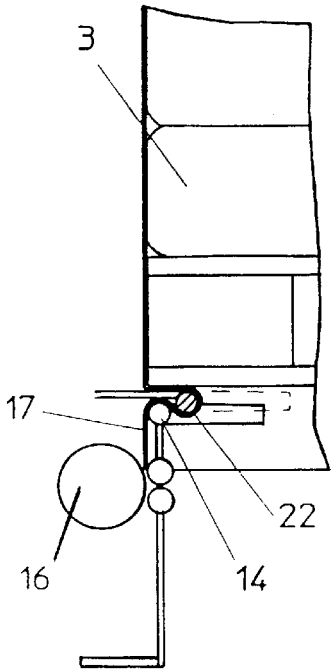
FIG. 5 shows a side view of the reefing finger and the associated stretching element in a third position.

The covering process will now be explain with reference to FIGS. 3–5; in connection with FIGS. 1–2.

The flat stretchable film tubing 5 is threaded over the guide elements 8 by drive rollers 7. When the apparatus is actuated, the guide elements 8 are located in a lowered position. At the lower end of the guide elements 8, each threaded-in edge of the tubing 5 is conducted between the respective twin conveyor belts 11, whereby opening of the tubing takes place. After a piece of a lower end of the tubing 5 extends out of the twin conveyor belt 11, the driving of the drive roller 7 and the twin conveyor belt is stopped, and the reefing fingers 14 are introduced into the lower end of the tubing 5. At that, the stretching elements 22 are located in the position shown in FIG. 3, i.e., outwardly of the respective fingers 14.

In this position, the four corners of the tubing 5 can be put on the reefing fingers 14. At that, the drive rollers 16 are advanced toward the reefing fingers 14 and are actuated. The drive rollers 16 operate, together with the drive rollers 7 and the twin conveyor belts 11, until a section of the tubing 5 corresponding to the height of the stack 3 is put over the reefing fingers 14 in a bellows-like manner. At that, a perfect folding is achieved by the drive rollers 16 flattening the tubular film 5 with aid of rollers 20, 20*a*. Then, the drive rollers 7, the conveyor belts 11, and the drive rollers 16 are stopped. The separating device 9 and the welding device 10 are actuated. After the separation and welding processes are finished, the conveyor belts 11 are actuated again. Simultaneously, the pivot levers 18 are pivoted downward, whereby the folded tubing edges are withdrawn or pulled out of the receiving ends of the twin conveyor belts 11.

As soon as the tubing is withdrawn from the twin conveyor belts 11, the reefing fingers 14 are displaced horizontally outwardly into the stretching position. The final run-out or horizontal stretching position is shown in FIG. 4. Before pulling of the reefed film cover over the stack starts, while the frame 15 is moved downwardly, the stretching elements 22 are moved inward and, if necessary, after passing the arches of the reefing fingers 14, somewhat downwardly. As a result, the stretching element 22 arrive at a position shown in FIG. 4. When the stretching process is initiated by lowering the frame 15 and before the stack 3 is lifted and released, the upper closed end of the stretch film cover 17, which was formed by welding, is placed on the upper surface of the stack 3, and the stretch film cover 17 is forcefully pulled around, as shown in FIG. 4, with the reefing fingers 14 and the stretching elements 22. Thereby, there is provided a first friction contact surface on the arch of reefing fingers 14 and a second additional contact surface on the stretching elements 22. Thus, a large contact surface is obtained, which makes possible a controlled and uniform sliding of the film cover by the reefing device.

At the end of the covering process, the reefing fingers 14, together with the stretching elements 22, are displaced, beneath the freely positioned pallet, inward to form a bottom cover section, as shown in FIG. 5.

In this position, the functioning of the stretching elements 22 is particularly important because a controlled sliding of the bottom region of the cover prevents the formation of side rides-up on the stack sides.

Figure 6:
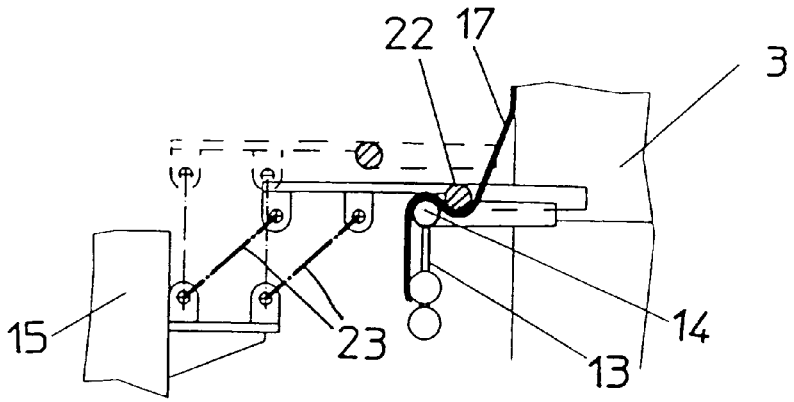
FIG. 6 shows a schematic view of a first embodiment of a stretching element.

In order to effect a horizontal and, if necessary, vertical displacement of the cover elements 22 relative to the frame 15 and, thus, relative to the reefing fingers 14, each stretching element can be provided with two separate piston-cylinder units or the like, which operate at an angle of 90° toward each other. A particularly advantageous embodiment of the stretching element is shown in FIG. 6. In this embodiment, the stretching element 22 is coupled to parallel arms 23 which are secured on the frame 15 and are actuated with a separate piston-cylinder unit (not shown). The stretching element is brought into the position shown in FIG. 6 by a pivotal movement of arms 23 from a position shown with dash lines.

In order to achieve, dependent on properties of the film and the requirement to the sheathing, large contact surfaces, the stretching elements can have different shapes. In FIGS. 3–6, respective L-shaped and arc-shaped stretching elements 22 can be formed with a circular cross-section.

Figure 7:
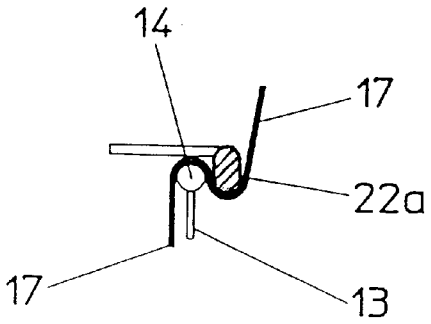
FIG. 7 shows a schematic view of a second embodiment of a stretching element.

FIG. 7 shows an embodiment in which the stretching element 22*a* has an oval cross-section. This permits to provide a grater arc contact for the film cover 17, i.e., to achieve a larger friction contact surface.

Figure 8:
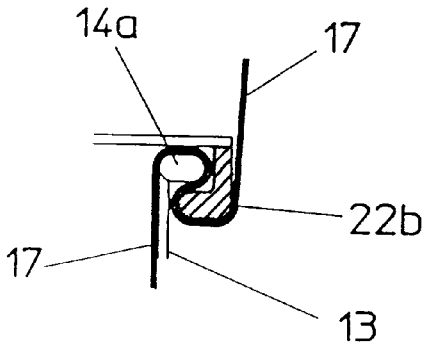
FIG. 8 shows a schematic view of a third embodiment of the stretching element.

FIG. 8 shows a further embodiment of the stretching element, designated in FIG. 8 with reference numeral 22*b*. It has a L-shaped cross-section. It permits to achieve even a larger arc contact, with the total arc contact (of the reefing finger 14 and the stretching element 22) being greater than 360°.

Naturally, the invention is not limited to the disclosed embodiments. Further modification within the scope of the present invention are also possible. Thus, the stretching element may have different forms. Also, different ways of horizontal and/or vertical adjustments of the stretching element can be devised. The reefing fingers and the stretching elements can be so formed that they would form substantially close rings. The reefing finger and the associated stretching element in this case can be telescopically arranged relative to each other. This modification would permit to further improve sliding of the film cover or cover in transitional regions of the stack, which would permit to achieve an even more uniform bottom stretching.

Therefore, it is not intended that the invention be limited to the disclosed embodiments or details thereof, and departure can be made therefrom within the spirit and scope of the appended claims.

What is claimed is:

1. An apparatus for covering a stack formed of articles supported on a support board with a stretch film, the apparatus comprising:

at least four reefing fingers movable in horizontal and vertical directions for picking up a film cover in four corners of the cover in a bellow-like manner, each reefing finger having a somewhat L-shaped arch;

an adjustable drive unit associated with each reefing finger for folding, in the bellows-like manner, the film cover onto an associated reefing finger; and a rigid stretching element associated with each reefing finger and movable relative to an associated reefing finger substantially horizontally and in such a way that a respective region of the cover, upon being pulled over the stack, moves over the associated reefing finger in an S-shaped manner and finally slides over the stretching element.

2. An apparatus as set forth in claim 1, further comprising a plurality of frames corresponding to a plurality of pairs of associated reefing fingers and stretching elements, with each frame supporting one pair of associated reefing fingers and stretching element.

3. An apparatus as set forth in claim 1, wherein each stretching element is arranged on a link formed of two parallel arms.

4. An apparatus as set forth in claim 1, wherein the stretching element has one of an oval cross-section and an ovoid cross-section.

5. An apparatus as set forth in claim 1, wherein the stretching element has a circular cross-section.

6. An apparatus as set forth in claim 1, wherein a reefing finger and an associated stretching element have each such a length that in a pulling over position thereof, they form at least an approximately closed ring.

7. A method of covering a stack formed of articles supported on a support board with a stretch film, the method comprising the steps of:

providing an apparatus having:

at least four reefing fingers movable in horizontal and vertical directions for picking up a film cover in four corners of the cover in a bellow-like manner, each reefing finger comprising a somewhat L-shaped arch, an adjustable drive unit associated with each reefing finger for folding, in the bellows-like manner, the film cover onto an associated reefing finger, and a rigid stretching element associated with each reefing finger and movable relative to an associated reefing finger substantially horizontally and in such a way that a respective region of the cover upon being pulled over the stack, moves over the associated reefing finger in an S-shaped manner and, finally, slides over the stretching element;

moving the reefing fingers horizontally into four corner regions of the cover, so that the reefing fingers engage the cover in the four corner regions;

placing the cover around the reefing fingers in a bellows-like manner;

moving, before an end of the placing process, the stretching elements radially outwardly and above the respective associated reefing fingers and moving the stretching elements, after reefing and before start of a pull-over process inward in a substantially horizontal direction toward the stack until the stretching elements are located closer to the stack than the respective reefing fingers;

moving the reefing fingers away from the stack in a horizontal surface exceeding a horizontal dimension of the stack;

thereafter, pulling the cover over the stack, with the cover being initially supported on upper edges of the stack.

8. A method as set forth in claim 7, wherein the stretching elements, after having been moved inward, are moved additionally downwardly.

* * * * *